US005577546A

United States Patent [19]

Kjar et al.

[11] Patent Number: 5,577,546

[45] Date of Patent: Nov. 26, 1996

[54] PARTICULATE FEEDSTOCK FOR METAL INJECTION MOLDING

[75] Inventors: Anthony R. Kjar, Victoria, Australia; Ronald G. Iacocca; Randall M. German, both of State College, Pa.; John L. Mihelich, Prospect, Ky.

[73] Assignee: Comalco Aluminium Limited, Melbourne, Australia

[21] Appl. No.: 397,047

[22] PCT Filed: Sep. 6, 1993

[86] PCT No.: PCT/AU93/00454

§ 371 Date: Apr. 24, 1995

§ 102(e) Date: Apr. 24, 1995

[87] PCT Pub. No.: WO94/06586

PCT Pub. Date: Mar. 31, 1994

[30] Foreign Application Priority Data

Sep. 11, 1992 [AU] Australia ..... PL4632
Jun. 29, 1993 [AU] Australia ..... PL9680

[51] Int. Cl.[6] ..... B22D 19/14; B22D 27/09; B22C 9/00; B22F 9/04; B22F 1/00

[52] U.S. Cl. ..... 164/97; 164/900; 164/113; 428/570; 419/23; 75/255

[58] Field of Search ..... 164/97, 900, 113; 75/255, 351; 428/570; 419/33, 23

[56] References Cited

U.S. PATENT DOCUMENTS

| | | | |
|---|---|---|---|
| 4,594,881 | 6/1986 | Imamura | 73/37.5 |
| 4,755,221 | 7/1988 | Paliwal et al. | 419/23 |
| 4,961,779 | 10/1990 | Kusui et al. | 419/23 |
| 4,971,755 | 11/1990 | Kawano et al. | 75/255 |
| 5,040,589 | 8/1991 | Bradley et al. | 164/900 |
| 5,314,658 | 5/1994 | Meendering et al. | 419/33 |
| 5,372,775 | 12/1994 | Hayashi et al. | 419/33 |

*Primary Examiner*—Jack W. Lavinder
*Assistant Examiner*—I.-H. Lin
*Attorney, Agent, or Firm*—Nikaido, Marmelstein, Murray & Oram LLP

[57] ABSTRACT

Particles of metal alloys and composites have been developed that are particularly suitable for use in producing thixotropic alloys and in the injection molding of such alloys. The particulate material comprises particles of metal alloy or composite, wherein a substantial proportion of the particles is shaped such that the ratio of the length of the largest dimension of a particle to the effective diameter of the particle is in the range of 1.0 to 4.0 and the substantial proportion of particles has a particle size wherein the largest dimension of the particles lies within the range of 0.5 to 5.0 mm. This allows convenient handling of the particles whilst also avoiding binding or clogging of the screw, in the case where a screw extruder is used.

16 Claims, 12 Drawing Sheets

PERCENTAGE FREQUENCY DISTRIBUTION OF ASPECT RATIO FOR GRANULE TYPE #1
NUMBER OF GRANULES IN SAMPLE → 158

FREQUENCY %
50
45
40
35
30
25
20
15
10
5
0
1
1.25
1.5
1.75
2
2.25
2.5
2.75
3
3.25
3.5
3.75
4
4.25
4.5
4.75
5
ASPECT RATIO

PARTICULATE FEEDSTOCK FOR METAL INJECTION MOLDING

CROSS-REFERENCE TO RELATED APPLICATION

This application is a 371 of PCT/AU93/00454, filed Det. 6, 1993.

BACKGROUND OF THE INVENTION

The present invention relates to a particulate material comprising an alloy or composite. The particulate material is especially suitable for use as a feed material in the injection moulding or casting of thixotropic alloys. As used herein, the terms "composite" or "alloy composite" include an alloy matrix having ceramic reinforcement, and includes metal matrix composites.

The semi-solid processing of alloys and composites is an area of technology in which much interest is presently being shown. Such processing generally requires the formation of a thixotropic alloy which is subsequently processed. Thixotropic alloys are produced when solid particles of a metal or alloy are homogeneously suspended in a liquid phase of molten metal. The semi-solid mass thus produced has thixotropic rheology.

Thixotropic alloys may be processed to produce metal articles by injection moulding.

A number of processes to produce thixotropic alloys have been proposed. U.S. Pat. Nos. 4,694,881 and 4,694,882 both assigned to the Dow Chemical Corp., the entire contents of which are herein incorporated by reference, describe processes for producing thixotropic alloys which comprise feeding solid particles of a metal alloy from a hopper into an extruder, such as a screw extruder. In U.S. Pat. No. 4,694,881, the solid particles are heated in the extruder to a temperature above the liquidus temperature of the alloy. The molten mass thus obtained is subsequently cooled to a temperature between the solidus and liquidus temperatures and subjected to shearing to break the dendritic structure that would otherwise form. The resulting liquid-solid composition of a thixotropic alloy is injected into a mould to form a moulded product.

U.S. Pat. No. 4,694,882 describes a similar process, except that the feed alloy particles are heated to a temperature between the solidus and liquidus temperatures, without complete melting of the feed metal particles taking place.

Both of the above processes utilise feed particles or chips of a convenient size for handling. The patents especially describe the use of chips having an irregular shape. The size of the particles used is described as not being critical to the invention, although relatively small particle sizes are preferred because of heat transfer and handling requirements.

Experiments carried out by the present applicant have shown that the particles used in the process described in U.S. Pat. Nos. 4,694,881 and 4,694,882 are prone to block the hopper and seize the screw extruder. Further, the particles do not exhibit good packing characteristics which can cause difficulty in achieving sufficient heat transfer rates to cause the partial melting of the metal particles and also render control over the temperature more difficult.

SUMMARY OF THE INVENTION

The present inventors have now developed particles of metal alloys and composites that are particularly suitable for use in producing thixotropic alloys and in the injection moulding of such alloys.

According to the first aspect, the present invention provides particulate material comprising particles of metal alloy or composite, wherein a substantial proportion of the particles are shaped such that the ratio of the length of the largest dimension of a particle to the effective diameter of the particle is in the range of 1.0 to 4.0 and that the substantial proportion of particles have a particle size wherein the largest dimension of the particles lies within the range of 0.5 to 5 mm. Preferably, the particles are shaped such that the ratio of the length of the largest dimension of a particle to the effective diameter of the particle is in the range of 1.2 to 3.0, more preferably 1.2 to 2.0. As used hereinafter, the ratio of the length of the largest dimension of a particle to the effective diameter of the particle will be denoted by the term "aspect ratio".

The effective diameter of a particle may be determined by determining the smallest circle that the particle will be able to pass through. The diameter of this circle is the effective diameter of the particle.

Preferably, the particles have a largest dimension in the range of 1 to 3 mm.

The particles are shaped such that the tap density of the mass of particles is preferably at least 50% of the theoretical density of the alloy or composite.

The particles preferably have a substantial smooth surface texture. In a preferred embodiment the substantial proportion of particles comprise at least 40% by weight of the mass of particles, preferably at least 60% by weight more preferably at least 80% by weight, most preferably at least 95% by weight of the mass of particles.

In one embodiment, the particles preferably have an approximately ovoid shape. Such particles may also be described as having a shape similar to a rugby football or as being the shape formed by the solid of revolution of an ellipse or generally elliptical shape about a longitudinal axis.

In another embodiment, the particles may have a generally tear drop shaped profile or have a profile that may be described as a flattened tear drop. In this embodiment, in a longitudinal cross-section of a particle, a first end of the particle will have a generally hemispherical or hemi-ovoidal shaped portion. The generally hemispherical or hemi-ovoidal shaped portion may be flattened, usually at a leading edge thereof. This portion will taper to a second end of the particle, where the particle will terminate at a point or at a portion having a small radius of curvature. The overall shape of the particle may be considered to be formed generally as the solid of revolution of the planar shape of the cross-section profile. Although the particle should have a substantially smooth surface texture, it will be appreciated that the particles will have a small degree of surface roughness (as will the football shaped particles).

In a second aspect, the present invention provides a method for producing a thixotropic alloy in which feed particles of a metal alloy or composite are heated and subjected to shear to produce a substantially homogenous mixture of solid particles and liquid wherein a substantial proportion of the feed particles each have a shape such that the ratio of the length of the largest dimension of a particle to the effective diameter of the particle is in the range of 1.0–4.0 and the substantial proportion of the particles have a particle size wherein the largest dimension of the particles lies in the range of from 0.5 to 5 mm.

In a preferred embodiment of the second aspect of the invention, the particles are shaped such that the ratio of the length of the largest dimension of a particle to the effective diameter of the particle is in the range of 1.2 to 3.0, more preferably 1.2 to 2.0.

The substantial proportion of feed particles preferably have a particle size wherein the maximum dimension of a substantial proportion of the particles is preferably in the range of from 1 to 3 mm. The particles preferably have a substantially smooth surface texture. In a preferred embodiment the substantial proportion of particles comprise at least 40% by weight of the mass of particles, preferably at least 60% by weight more preferably at least 80% by weight, most preferably at least 95% by weight of the mass of particles.

The thixotropic condition may be produced by any suitable process that involves heating and shearing the particles. However, it is particularly preferred that the thixotropic condition is produced by use of a screw extruder apparatus. In this case, the feed particles may be supplied to a screw extruder whereupon they enter a first heating zone and are heated to a temperature above the melting point of the alloy or composite. The molten material may then pass to a second zone where the molten metal is cooled to a temperature below the liquidus temperature and above the solidus temperature. Solidification of some of the material will occur to form a mixture of solid particles and liquid. The screw of the extruder is caused to rotate such that the mixture is sheared to prevent the formation of large crystal structures and a thixotropic material is formed.

Alternatively, the feed particles may be heated in a first zone of the screw extruder to a temperature above the solidus temperature of the material but below the liquidus temperature of the material. Shear is applied to the resulting mixture of liquid and solid particles by rotation of the screw of the extruder to produce the thixotropic material.

It will be appreciated that the method of the present invention is not restricted to use of a screw extruder, but that any means that is capable of heating the feed particles to the required temperature and supplying a shearing force to the mixture of liquid metal and solid particles may be used. For example, the mixture may be subjected to the action of a rotating plate or it may be forced to travel through a tortuous path extruder in order to impart sufficient shearing force Go the mixture to produce the thixotropic material. As a further alternative, electromagnetic stirring may be used to obtain the thixotropic material.

The feed particles may be supplied from a hopper by gravity feed or conveyor feed.

The thixotropic material formed by the method of the second aspect of the invention is especially suitable for use in the production of metal components by injection moulding. Accordingly, the present invention also provides a method for producing an article which comprises heating and shearing feed particles comprising a metal alloy or composite to produce a substantially homogenous mixture of solid particles and liquid, injecting said mixture into a mould, allowing the mixture to at least partially solidify in the mould and removing the article from the mould, wherein a substantial proportion of the feed particles are shaped such that the ratio of the length of the longest dimension of a particle to the effective diameter of the particle is in the range of 1.0 to 4.0 and the substantial proportion of particles have a particle size wherein the largest dimension of the particles lies within the range of 0.5 mm to 5 mm.

Preferably, the particles are shaped such that the ratio of the length of the longest dimension of a particle to the effective diameter of the particle is in the range of 1.2 to 3.0, more preferably 1.2 to 2.0.

The particles of the present invention may be of any required metal alloy or composite thereof. Some suitable materials include metal and intermetallic alloys based on lead, aluminium, zinc, magnesium, copper and iron. The preferred particles are alloys of aluminium.

BRIEF DESCRIPTION OF THE DRAWINGS

The invention will now be further described with reference to the FIGURES in which.

DETAILED DESCRIPTION OF THE PREFERRED EMBODIMENTS

Figure 1:
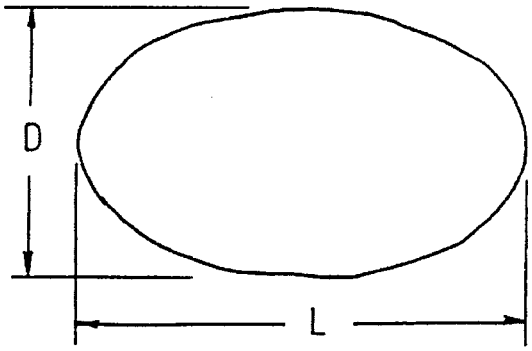
FIG. 1 shows a schematic profile view of "football" shaped particles according to the invention.

In a preferred embodiment, a substantial proportion of the particles of the particulate material of the present invention have an approximately ovoid particle shape with a ratio of the largest dimension to the effective diameter of between 1.2 and 3.0, more preferably 1.2 to 2.0. This ratio may be designated the aspect ratio of the particles. These particles can be further characterised as being in the shape of an elongated sphere or shaped like a rugby ball. A preferred shape of the particles is shown schematically in FIG. 1. The aspect ratio for the particles is determined from the ratio of length to effective diameter for the particles. Thus, referring to FIG. 1, the invention requires that:

L/D=1.0 to 4.0, preferably 1.2–3.0, more preferably 1.2–2.0

The dimension L preferably lies within the range of 0.5 to 5 mm.

Figure 2:
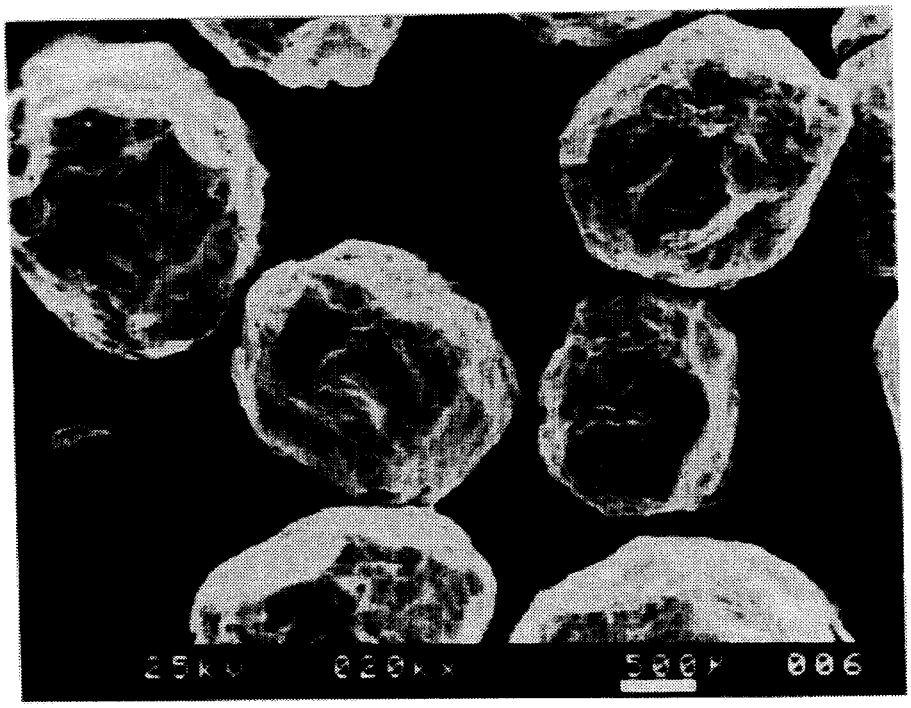
FIG. 2 shows a scanning electron micrograph of the actual particles shown schematically in FIG. 1.

FIG. 2 shows a scanning election micrograph of actual particles that are generally ovoid shape. The particles may also be described as of generally cylindrical shape and having rounded ends.

Figure 3:
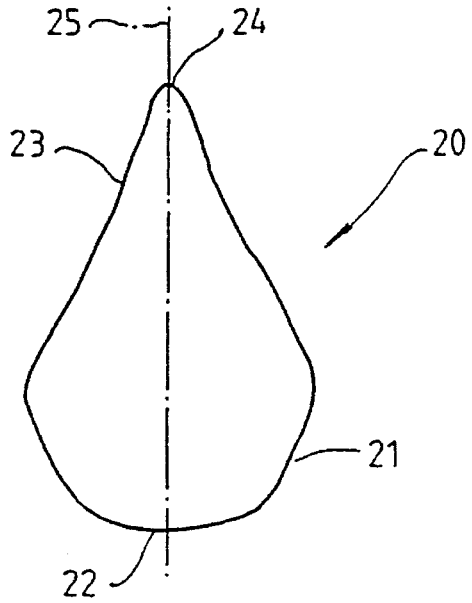
FIG. 3 shows a schematic cross-section view of another particle according to the invention.

In a further embodiment, the particles have a generally tear drop shape that may be flattened at one end. With reference to FIG. 3, which shows a cross-sectional view of a particle, particle 20 of generally flattened tear drop shape has a first end 21 that is in the form of a generally hemispherical or hemi-ovoidal shape. First end 21 may be flattened at leading edge 22. Particle 20 is shaped such that first end 21 tapers towards second end 23. Second end 23 terminates at a point or at a portion 24 having a small curvature of radius.

FIG. 3 shows a cross-sectional view of particle 20. The overall shape of the particle may be considered to be in the form of a solid of revolution of the cross-section about longitudinal axis 25.

Figure 4:
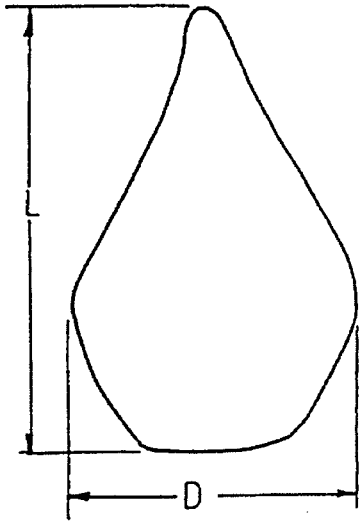
FIG. 4 shows a similar view to FIG. 3 showing the calculation of aspect ratio for such particles.

Referring to FIG. 4, the aspect ratio of particle 20 falls within the range of 1.0 to 4.0, preferably 1.2 to 3.0, more preferably 1.2 to 2.0. As with the football shaped particles, the aspect ratio of particle 20 is given by the ratio L/D. Here, dimension L may be considered to be the maximum height of the particle. Dimension D is the diameter of the smallest circle that the particle is able to pass through.

Figure 5:
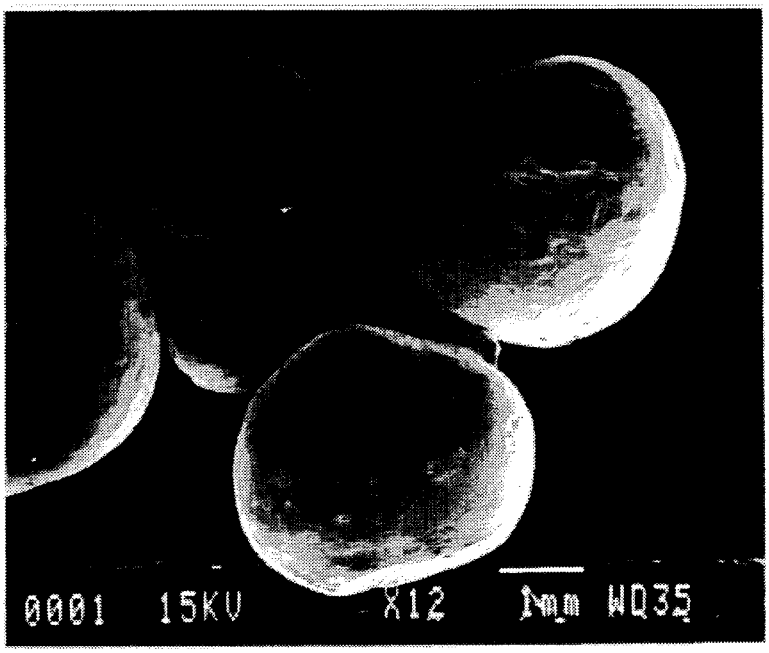
FIGS. 5 and 6 show scanning electron micrographs of further particles according to the present invention.
Figure 6:
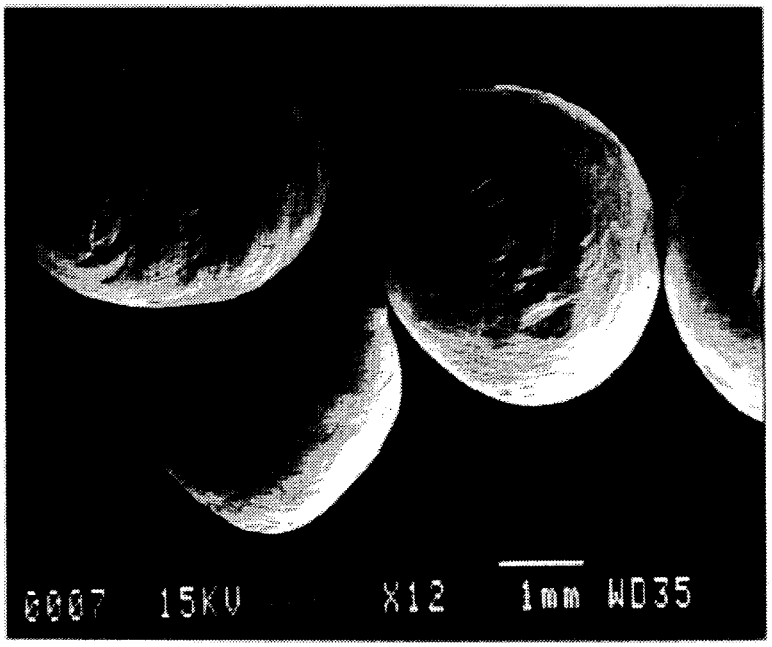
Figure 7:
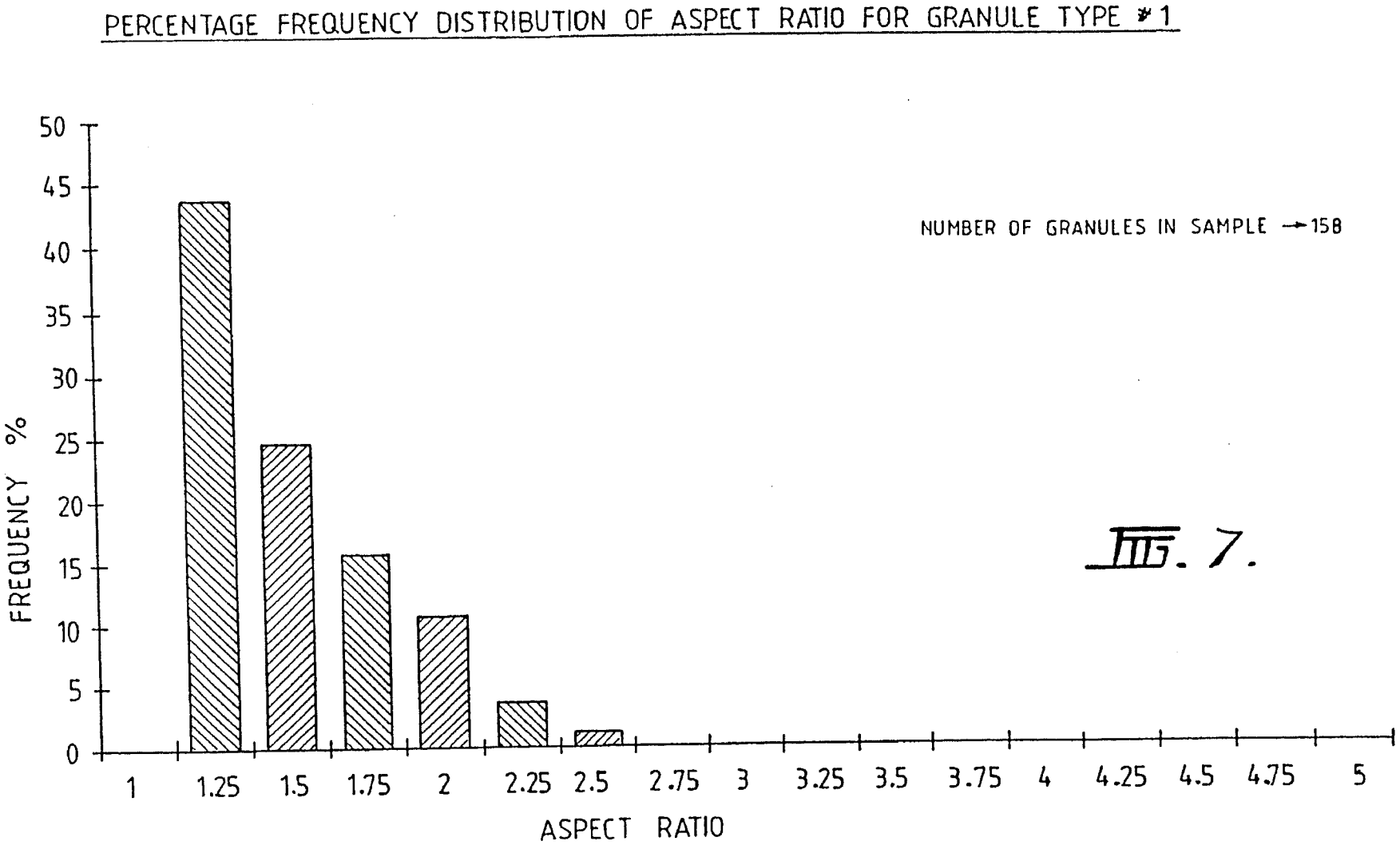
FIG. 7 shows a percentage frequency distribution of aspect ratio for granule type 1.
Figure 8:
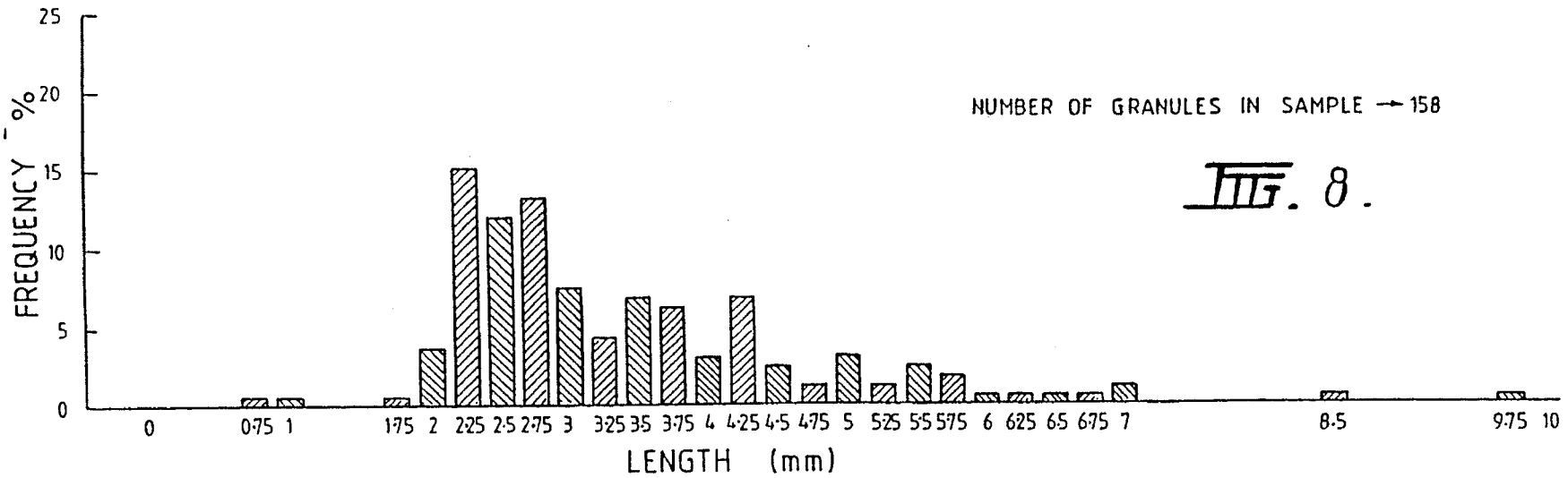
FIG. 8 shows a percentage frequency distribution of the dimension "length" for granule type 1.
Figure 9:
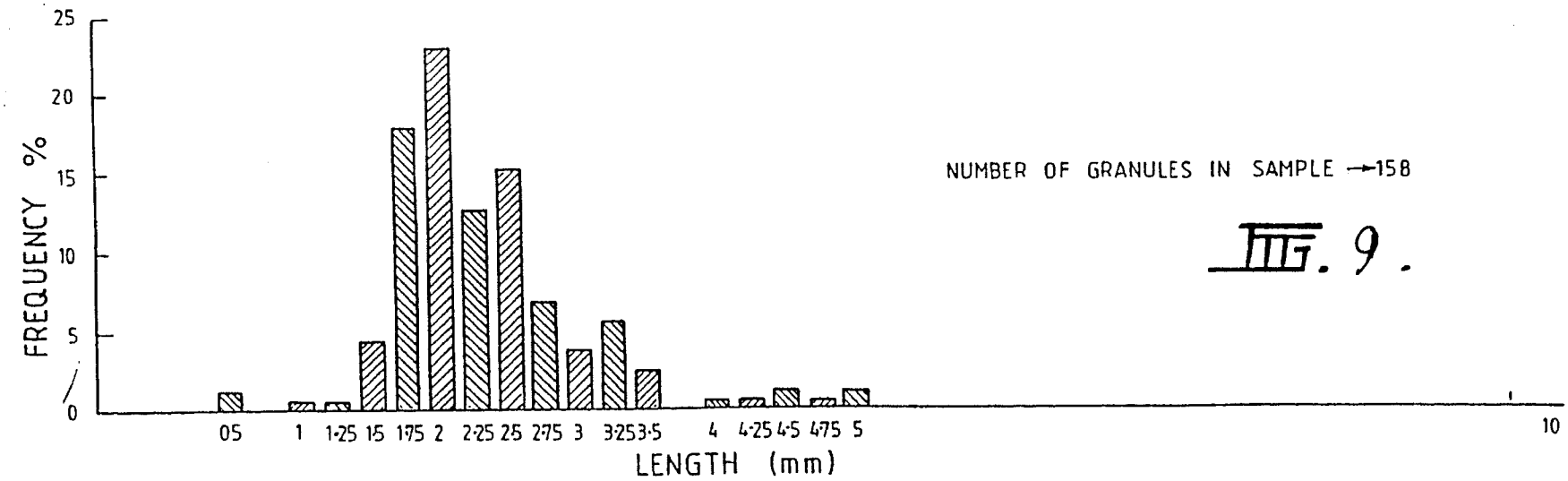
FIG. 9 shows a percentage frequency distribution of the dimension "width" for granule type 1.
Figure 10:
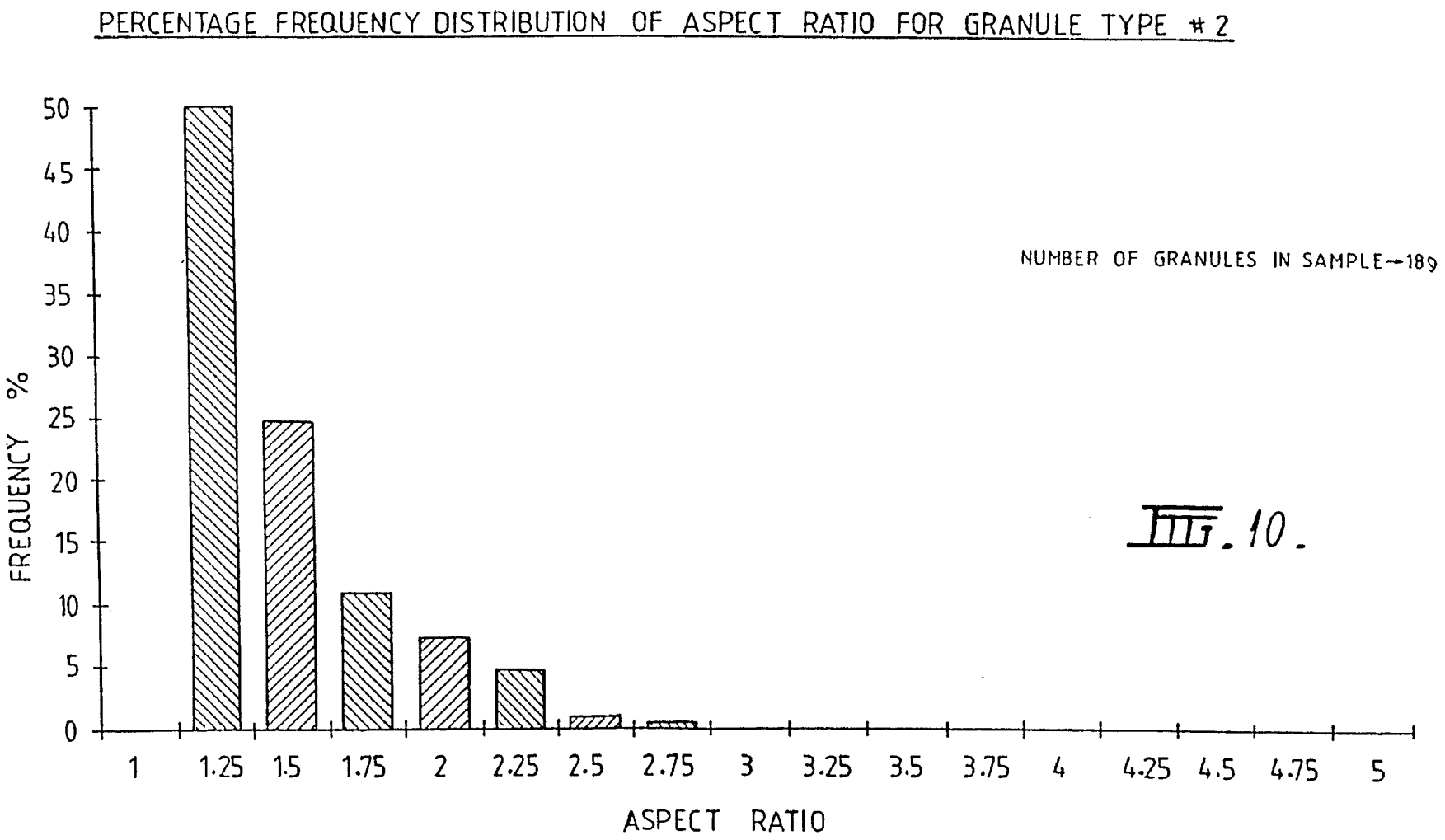
FIG. 10 shows a percentage frequency distribution of aspect ratio for granule type 2.
Figure 11:
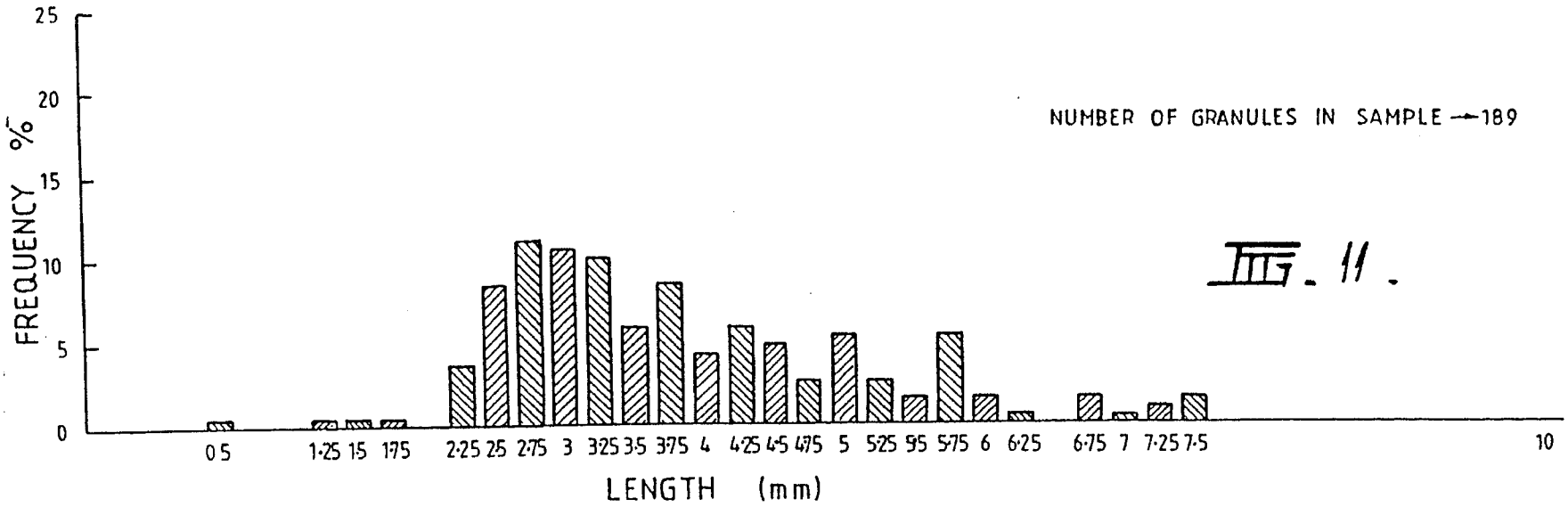
FIG. 11 shows a percentage frequency distribution of the dimension "length" for granule type 2.
Figure 12:
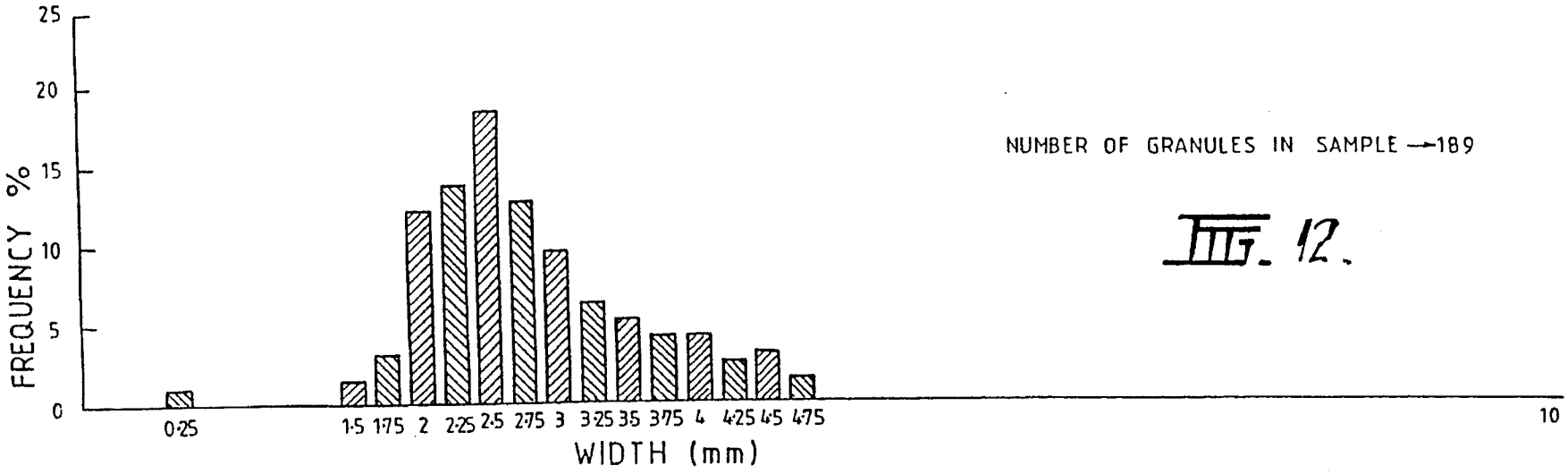
FIG. 12 shows a percentage frequency distribution of the dimension "width" for granule type 2.

Scanning electron micrographs of further particles that fall within the scope of the present invention are shown in FIGS. 5 and 6.

The particulate matter of the present invention should include a substantial proportion of particles shaped according to the embodiments described above. In producing the particulate matter of the invention, it has been found that a substantial proportion of irregularly shaped particles are also formed and become included in the particulate matter. The presence of such irregularly shaped particles does not unduly affect the properties of the particulate matter unless the irregularly shaped particles are present in an unacceptably large amount.

When used in the methods of the present invention for producing a thixotropic material or a metallic article by the injection moulding of a metal alloy or composite, the substantial proportion of the mass of feed particles are preferably sized such that the overall length of the particles is in the range of 0.5 to 5 mm, more preferably 1 to 3 mm. This allows convenient handling of the particles whilst also avoiding binding or clogging of the screw, in the case where a screw extruder is used.

The particulate material of the present invention has a combination of properties that is not found in any metallic particulates currently known to the applicants and these combination of properties make the particulates especially suitable for use as feedstock in thixomolding processes. The particulate material of the invention has a tap density that is at least 50% of the theoretical density. This ensures good particle to particle contact and allows adequate heat transfer rates to be achieved in the heating zone. This allows for relatively short heating times to be used to cause the initial melting or partial melting of the particles and it also allows for close control over temperature to be maintained to enable the thixotropic state to be maintained. The particulate material is relatively free flowing and will be unlikely to block a feed hopper. The mixing torque required to turn the screw when the particulate material fills a screw extruder is not unacceptably high and the particles are sufficiently large to ensure that particles cannot slip between the walls of the extruder and the screw to cause binding of the screw.

The properties of a group of particulate materials were determined in order to compare them with the properties of the mass of particles of the present invention. The particles used for comparison purposes were made of aluminium and consisted of powder (100 μm), needles, granules and irregular shaped machining chips. Although some of these particles showed properties in one category that were superior to the properties of the particles of the invention in that category, none of the comparative particles had a combination of properties that were as desirable or useful as the properties of the particulate matter of the invention.

The particulate material of the present invention may be mixed with particles of other shapes and sizes. However, this is generally not preferred due to possible problems associated with segregation and settling of the resultant mixture.

In order to quantify the performance of particulate matter of the invention, a series of comparative tests were run to compare the properties of the "football" particles with a series of commercially available particles. The particles used for comparison purposes were aluminium granules, aluminium needles, aluminium spherical powder (100 μm average particle size) and aluminium machinery chips. These particles were tested for particle size, particle shape, apparent density, tap density, flow rate through a standard funnel, mixing torque and angle of repose. The data obtained is shown in Table 1.

Using three characterisation tests of flow time, tap density and mixing torque, the particles were ranked according to performance (a ranking of "1" signifies the best performance). The rankings are shown in Table 2.

TABLE 1

| | Particle Size | | | Apparent Density | | Tap Density | | | |
|---|---|---|---|---|---|---|---|---|---|
| Particles | Average Length (mm) | Average Width (mm) | Particle Shape | g/cc | % of theoretical | g/cc | % of theoretical | Mixing Torque (in - lbs) | Angle of Repose (°) |
| granules | | | irregular | 0.54 | 20.0 | 0.63 | 23.2 | 7.20 | 34 |
| needles | 4.29 | 0.62 | needles | 1.08 | 40.0 | 1.39 | 51.5 | 19.20 | 32 |
| machining chips | | | irregular | 0.20 | 7.4 | 0.23 | 8.4 | | 40 |
| machining chips (tumbled) | | | irregular | 0.19 | 7.0 | 0.24 | 8.8 | | 35 |
| machining chips (milted-light) | | | irregular | 0.19 | 7.0 | 0.22 | 8.1 | | 35 |
| machining chips (milted-heavy) | | | irregular | 0.24 | 8.7 | 0.30 | 11.2 | | 43 |
| granules | | | irregular | 0.54 | 20.1 | 0.60 | 22.0 | 22.80 | 30 |
| spherical powder | 0.10 | | spherical | 1.39 | 51.5 | 1.61 | 60.0 | | 24 |
| particulate matter of the invention | 1.63 | | | 1.49 | 55.3 | 1.56 | 57.9 | 15.20 | 22 |

TABLE 2

| Ranking of particulates using key parameters | | | |
|---|---|---|---|
| | Rank | | |
| Particulate | Flow Time | Tap Density | Mixing Torque |
| Needles | 3 | 3 | 3 |
| Granules | 5 | 4 | 1 |
| Granules | 4 | 5 | 4 |
| Spherical Powder | 1 | 1 | — |
| Particulate Matter of the Invention | 2 | 2 | 2 |

At first glance, it appears that the spherical powder provides the best performance in two of the three categories. However, the powder seized between the screw and the wall of the torque measuring device and it is likely that this will also occur in thixomolding apparatus. Accordingly, the spherical powder is unsuitable as a feedstock for thixomolding.

Once the spherical powder has been eliminated as a potential feedstock, it is apparent that the particulate matter of the present invention is the most suitable for use as a feedstock for thixomolding processes.

In order to demonstrate the advantages of the present invention, a number of particles were prepared and compared with particles that are not encompassed by the present invention.

The particles that fall within the scope of the present invention have been denoted as "granule type #1" and "granule type #2". The summary of the granule dimensions is given in Table 3.

TABLE 3

| Summary of Granule Dimensions | | | | | |
|---|---|---|---|---|---|
| Granule Type (sample number) | Length (mm) | | Width (mm) | | Aspect Ratio |
| | Average | Std. Dev. | Average | Std. Dev. | |
| Type #1 (158) | 3.55 | 1.39 | 2.46 | 0.74 | 1.41 |
| Type #2 (189) | 3.99 | 1.35 | 2.90 | 0.78 | 1.36 |

Particle size analysis of granule type #1 and granule type #2 was carried out and the results of this particle size analysis, given as percentage frequency distribution of aspect ratio, percentage frequency distribution of the dimension "length" and percentage frequency distribution of the dimension "width" (diameter), for granule type #1 and granule type #2, are shown in FIGS. 5 to 10. The granules were produced from an Al 7% Si alloy.

Granule types #1 and #2 were found to be free flowing as no mixing torque could be measured. In addition, the granules transported easily along the barrel of the torque measuring device. The granules were found to have an apparent densityof from 56–58% of the theoretical apparent density and a tap density of 69% of the theoretical tap density.

For comparative purposes, samples of particles comprising mainly needles were obtained. All of the needles caused seizing of the screw during moulding screw simulation. The apparent density of the needles ranged from 39 to 45% of the theoretical value and the tap density ranged from 50 to 59% of the theoretical value. The needles were of a similar aluminium alloy as the granule types #1 and #2.

Several experiments with an Al 7% Si alloy were also carried out in which the granule types #1 and #2 and the needles were used to make a slurry of solid metal with liquid metal. These trials simulated the formation of a thixotropic alloy. The slurry was produced in a stirred silicon carbide crucible. The stirrer had two flights of blades. The procedure involved preheating a sufficient amount of particles to 400° C. The furnace temperature was set at 590° C., which is between the solidus and liquidus temperatures for the aluminium alloy used in the particles. The pre-heated particles were charged into the crucible such that the second flight of the stirrer made contact with the particles during stirring, although the particles did not cover the second flight of blades at this stage. The stirring speed was set at 100 rpm.

Aluminium alloys are expected to be a difficult feedstock for thixomolding processes because at about 400° C., aluminium-containing particles stick to each other. This particle adhesion would tend to produce blockages in the feed screw of a thixomolding apparatus.

The crucible tests to simulate the formation of a thixotropic alloy showed that granule types #1 and #2 both produced a slurry without any difficulties. Observations of the method were as follows:

- on initial and subsequent furnace charges, no evidence of granule adhesion (i.e., binding together was not apparent
- after stirring for approximately 30–40 minutes the onset of granule melting was obvious with the formation of large, solid lumps of material
- a decrease in the stirring efficiency was noticed as material continuously built-up around the crucible wall.
- to increase stirring efficiency, stirring was periodically stopped to allow material removal from the crucible wall. In addition, if material build-up was rapidly re-established, a granule addition was then carried out to facilitate build-up removal and good mixing
- granule additions were also necessary due to a reduction of material volume during melting.

With regard to the needles, some problems were encountered in producing a slurry using needles. These include:

- evidence of needles binding together due to the 400° C. preheating stage. This observation was made during the initial and subsequent charges associated with the trial
- the binding together of the needles was accentuated when the needles came in contact with the hot walls of the crucible. On mixing, large lumps formed immediately causing the motor to labour. (Note: stirring was stopped for ~15 minutes and the furnace temperature increased to allow material "softening".
- once the lumps had broken down, there were no problems with mixing the material, except for material build-up around the crucible wall.

In addition to the above difficulties, it is also noted that the needles would tend to seize the screw of the thixomolding apparatus during feeding.

Figure 13:
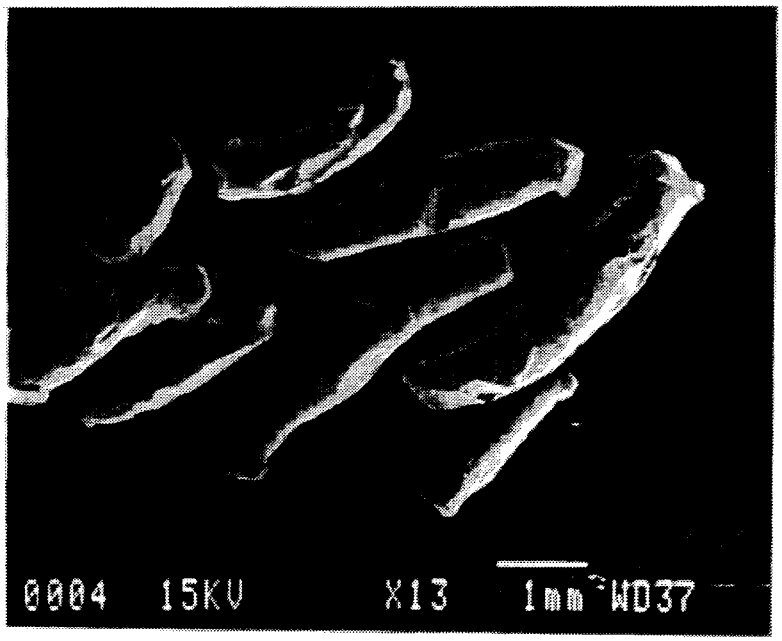
FIG. 13 shows a scanning electron micrograph of particles according to the invention which have a more needle-like structure.
Figure 14A:
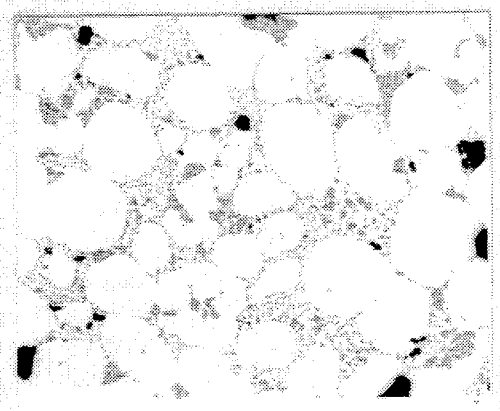
FIG. 14 shows photomicrographs of a slurry produced in crucible tests at 575° C. using granule type 1.
Figure 14B:
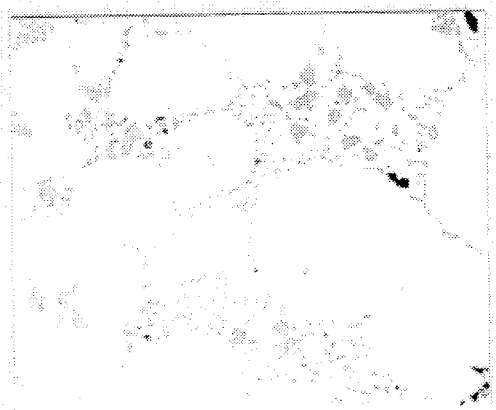
Figure 14C:
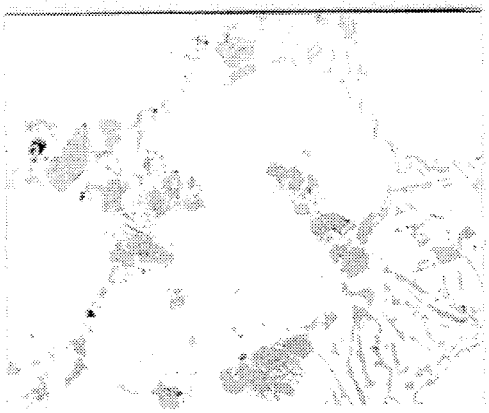
Figure 14D:
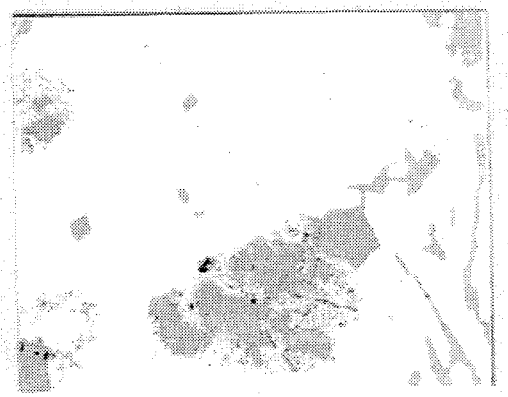
Figure 15A:
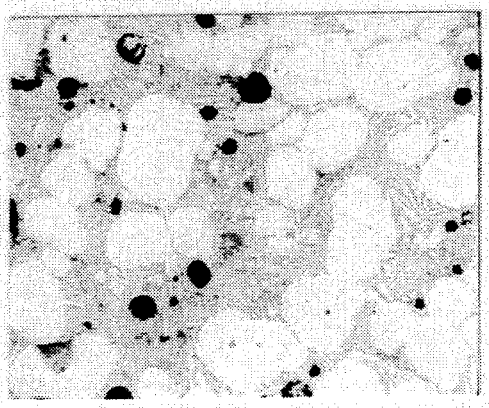
FIG. 15 shows photomicrographs of a slurry produced in crucible tests at 590° C. using granule type 1.
Figure 15B:
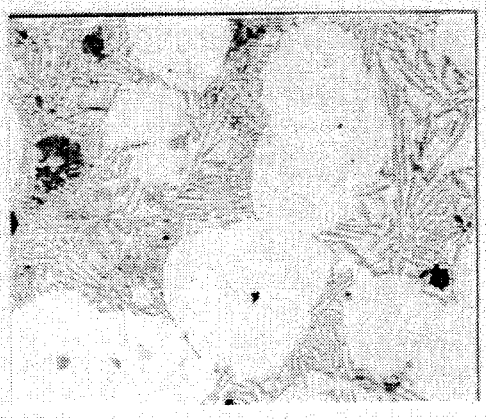
Figure 15C:
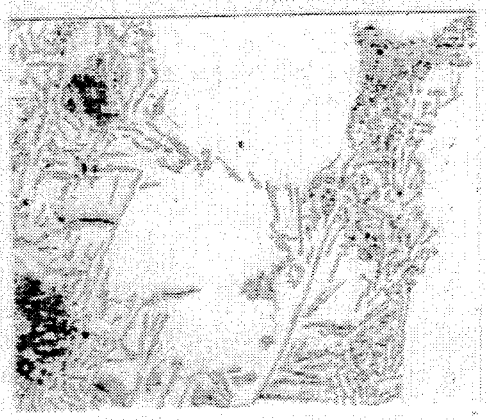
Figure 15D:
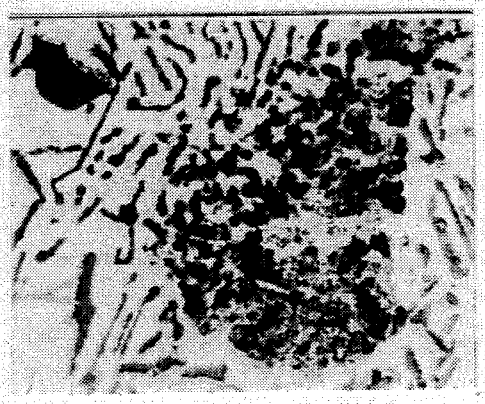
Figure 16A:
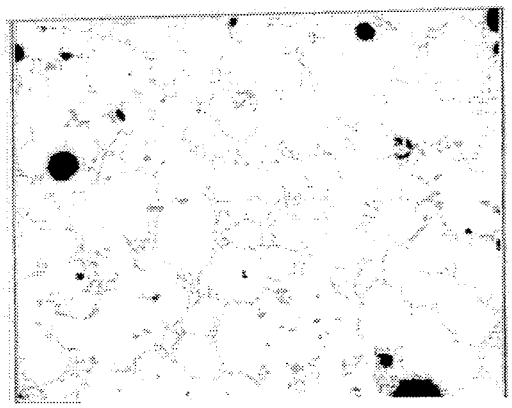
FIG. 16 shows photomicrographs of a slurry produced in a crucible test at 575° using granule type 2.
Figure 16B:
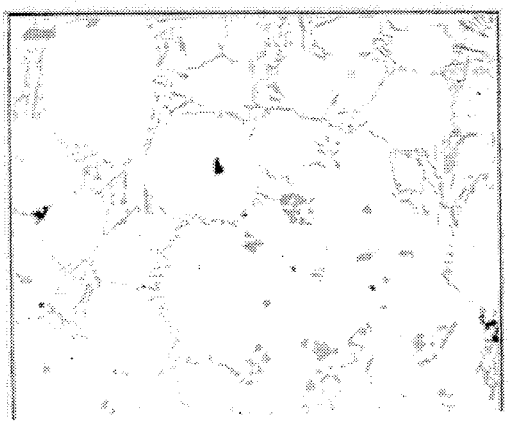
Figure 16C:
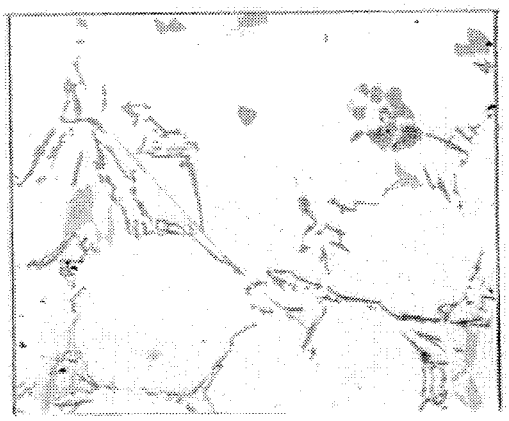
Figure 16D:
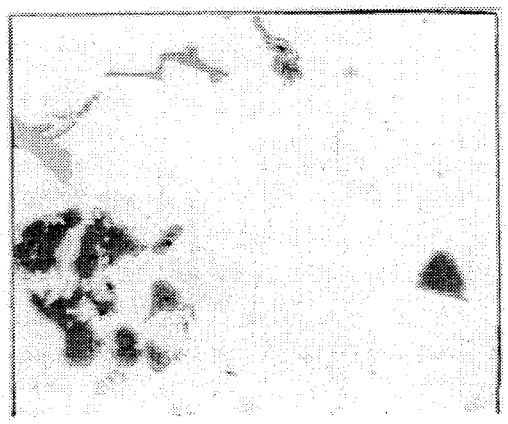
Figure 17A:
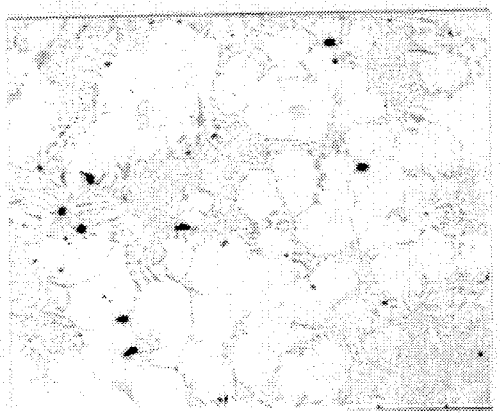
FIG. 17 shows photomicrographs of a slurry produced in a crucible test at 590° C. using granule type 2.
Figure 17B:
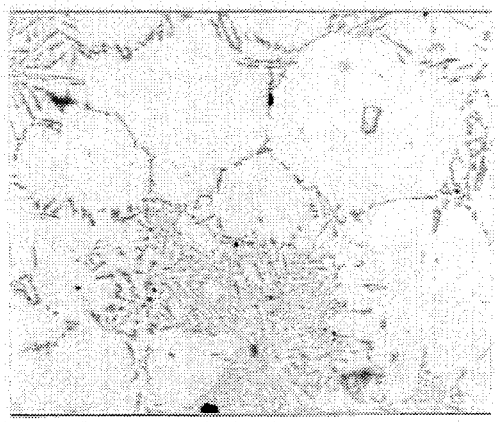
Figure 17C:
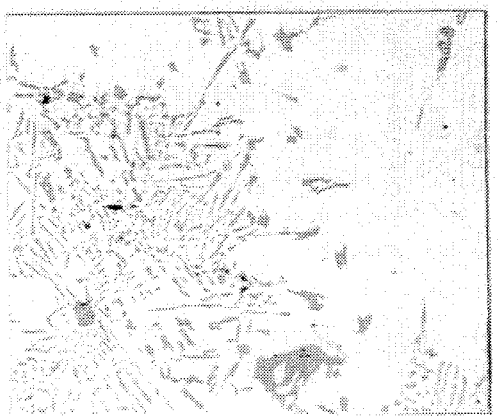
Figure 17D:
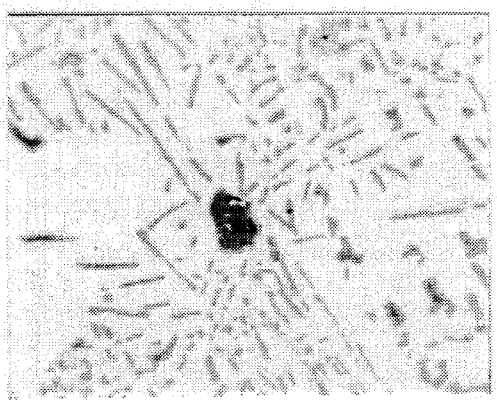

A mass of more needle-like particles, a scanning electron micrograph of which is shown in FIG. 13, were also subjected to a crucible test. These particles, which had an average length of 2.8 mm and an average width of 0.8 mm (aspect ratio of 3.4) fall within the scope of the present invention. Although the difficulties mentioned above in respect of needles were present to some degree, the particles of FIG. 13 were able to form useful slurries and hence would be an acceptable feedstock for thixomolding. Seizing of the screw is likely to be less of a problem with the particles of FIG. 13 than with long, thin needles having aspect ratios above 4.

The slurries obtained using granule types #1 and #2 were allowed to solidify and photomicrographs were subsequently taken. FIGS. 14 and 15 show photomicrographs of the slurries obtained using granule types 1 at 575° C. and 590° C. respectively. FIGS. 16 and 17 show similar photomicrographs for granule types 2. The slurries were obtained by heating the granules up from room temperature to a temperature between the solidus and liquidus of the alloy. The photomicrographs clearly show solid particles surrounded by regions of solidified liquid. A fair amount of porosity is also present, which is due to the stirring arrangement used in the crucible experiments. The porosity is not expected to be present when a thixomolding apparatus is used.

We claim:

1. Particulate material comprising particles of a metal alloy or composite, wherein a substantial proportion of the particles is shaped such that for the substantial portion of the particles the ratio of the length of the largest dimension of any particle to the effective diameter of the particle is in the range of 1.2 to 4.0, the substantial portion of the particles has a particle size wherein the largest dimension of any particle is in the range of 0.5 to 5 mm and the particulate material is substantially free of particles having a particle size of less than 0.5 mm.

2. Particulate material as claimed in claim 1 wherein the ratio of the length of the largest dimension of any particle to the effective diameter of the particle is in the range of 1.2 to 3.0.

3. Particulate material as claimed in claim 1 wherein the ratio of the length of the largest dimension of any particle to the effective diameter of the particle is in the range of 1.2 to 2.0.

4. Particulate material as claimed in claim 1 wherein the substantial proportion of the particles has a particle size wherein the largest dimension of any particle is in the range of 1 to 3 mm.

5. Particulate material as claimed in claim 1 wherein the substantial proportion of the particles comprises at least 40% by weight of the particulate material.

6. Particulate material as claimed in claim 1 wherein the particulate material has a tap density of at least 50% of the theoretical density.

7. Particulate material as claimed in claim 1 wherein the substantial proportion of the particles includes particles having an approximately ovoid shape.

8. Particulate material according to claim 1 wherein the substantial proportion of the particles includes particles having a generally tear drop shaped profile or a generally flattened tear drop shaped profile.

9. Particulate material as claimed in claim 1 wherein the particles have a substantially smooth surface texture.

10. Particulate material as claimed in claim 1 wherein the particles comprise an aluminium alloy or an aluminium composite.

11. A method for producing a thixotropic alloy comprising providing particulate material comprising particles of a metal alloy or composite, wherein a substantial proportion of the particles is shaped such that for the substantial proportion of the particles the ratio of the length of the largest dimension of any particle to the effective diameter of the particle is in the range of 1.2 to 4.0, the substantial proportion of the particles has a particle size wherein the largest dimension of any particle is in the range of 0.5 to 5 mm and the particulate material is substantially free of particles having a particle size of less than 0.5 mm, heating said particulate material and shearing said particulate material, thereby producing a substantially homogenous mixture of solid particles and liquid.

12. A method as claimed in claim 11, wherein the thixotropic alloy is produced using any of a rotating plate, a tortuous path extruder and an electromagnetic stirrer.

13. A method as claimed in claim 11 wherein the thixotropic alloy is produced using a screw extruder apparatus.

14. A method as claimed in claim 13, wherein said heating step comprises heating said particulate material in a first zone to a temperature above the melting point of the particulate material, thereby forming a molten material, and cooling the molten material in a second zone to a temperature below the liquidus temperature but above the solidus temperature of the particulate material, and said shearing step comprises rotating the screw extruder apparatus in the second zone, thereby preventing formation of large crystal structures in the molten material.

15. A method as claimed in claim 13, wherein said heating step comprises heating the particulate material to a temperature above the solidus temperature but below the liquidus temperature of the particulate material to form a mixture, and said shearing step comprises rotating the screw extruder apparatus, thereby preventing formation of large crystal structures in the mixture.

16. A method for producing an article, comprising heating and shearing particulate material comprising particles of a metal alloy or composite, wherein a substantial proportion of the particles is shaped such that for the substantial proportion of the particles the ratio of the length of the largest dimension of any particle to the effective diameter of the particle is in the range of 1.2 to 4.0, the substantial proportion of the particles has a particle size wherein the largest dimension of any particle is in the range of 0.5 to 5 mm and the particulate material is substantially free of particles having a particle size of less than 0.5 mm, thereby producing a substantially homogenous mixture of solid particles and liquid, injecting said mixture into a mould, allowing the mixture to at least partially solidify in the mould and removing the article from the mould.

* * * * *